United States Patent [19]

Crane

[11] Patent Number: 4,496,053

[45] Date of Patent: Jan. 29, 1985

[54] STACKING WIRE FOR PRODUCE CONTAINERS

[75] Inventor: Walton B. Crane, Sherman Oaks, Calif.

[73] Assignee: Industrial Designs & Services, Oxnard, Calif.

[21] Appl. No.: 427,557

[22] Filed: Sep. 29, 1982

[51] Int. Cl.[3] ..... B65D 5/46

[52] U.S. Cl. ..... 206/510; 229/16 C; 229/52 AW

[58] Field of Search ..... 206/503, 509, 510, 821; 229/34 HW, 52 AW, DIG. 11, 16 C, 52 AM

[56] References Cited

U.S. PATENT DOCUMENTS

| | | | |
|---|---|---|---|
| Re. 26,386 | 5/1968 | Crane | 229/23 |
| 2,868,430 | 1/1959 | Hamilton | 229/34 R |
| 2,896,835 | 7/1959 | Burkhardt et al. | 229/34 R |
| 2,914,235 | 11/1959 | Jones | 229/34 R |
| 2,971,232 | 2/1961 | Crane | 24/37 |
| 2,987,198 | 6/1961 | Crane | 206/504 |
| 3,026,008 | 3/1962 | Bertram | 229/52 AW |
| 3,118,563 | 1/1964 | Suchodolski | 220/97 |
| 3,194,472 | 7/1965 | Crane | 229/23 |
| 3,211,326 | 10/1965 | Davis | 206/510 |
| 3,750,936 | 8/1973 | Crane | 229/52 AW |
| 4,039,119 | 8/1977 | Crane | 229/52 A |
| 4,039,121 | 8/1977 | Crane | 229/52 A |
| 4,266,714 | 5/1981 | Crane | 229/34 HW |

*Primary Examiner*—Stephen Marcus
*Assistant Examiner*—David Voorhees
*Attorney, Agent, or Firm*—Fulwider, Patton, Rieber, Lee & Utecht

[57] ABSTRACT

An improved stacking wire is provided for use in carrying and supporting stacked produce containers of the type formed from corrugated paperboard or the like to include a pair of double-layer end walls each defining a vertically open slot for receiving a stacking wire. The improved stacking wire is bent to an inverted generally U-shaped configuration and includes a plurality of spacers disposed at different vertical positions therein for maintaining the end wall layers of a plurality of stacked containers in a predetermined spacing relative to each other and in vertical alignment with the end wall layers of other containers in the stack thereby increasing the vertical stacking strength and lateral stability of the stacked containers to prevent damage to the produce during handling, storage, or shipment.

20 Claims, 4 Drawing Figures

STACKING WIRE FOR PRODUCE CONTAINERS

BACKGROUND OF THE INVENTION

This invention relates generally to boxes or containers for produce and the like and to stacking devices or implements for use in carrying, stacking, and palletizing the containers for storage and/or shipment. More particularly, this invention relates to an improved stacking wire for use with lightweight produce containers formed from corrugated paperboard or the like to improve the vertical stacking strength of the containers thereby permitting the containers to be stacked to a considerable height in pallets or the like without fear of collapsing or becoming unstable.

Agricultural produce, such as grapes, strawberries, and the like, is commonly picked in the field and packed directly into relatively flat, open-topped trays or containers which are in turn stacked on pallets at substantial heights for storage and/or shipment to a market for sale. These containers are typically discarded after sale of the produce, whereby the containers are consumed in large numbers during each growing season. As a result, in an effort to reduce the cost of the produce to consumers, the produce containers are frequently formed at least in part from lightweight, folded corrugated paperboard or the like. However, paperboard produce containers do not by themselves have sufficient vertical stacking strength and/or lateral stability to withstand the significant forces encountered when the containers are stacked for storage and/or shipment.

To help prevent crushing of stacked produce containers and resultant destruction of the fragile produce, a variety of devices or implements have been proposed intended to minimize the likelihood of stack instability or collapse during shipment and/or storage. Perhaps the most common of such devices comprises a so-called stacking wire bent to have an inverted generally U-shaped configuration with laterally projecting lower wings for locking reception into a vertical slot defined by a double-layer end or side wall of the container. The stacking wire is sized to project upwardly through a vertical slot defined by the associated side or end wall of another container to provide a convenient carrying device for two containers and further to align with additional pairs of containers in a stack to help maintain the slotted end or side walls in vertical alignment with each other. With this alignment, the double-layer end or side walls of the stacked containers are intended to provide vertical support columns bearing the weight of the stack to help prevent crushing of the individual containers. However, these stacking wires in the past have not been designed to prevent lateral shifting or so-called shoeing in of the double-layer end or side walls, wherein such shifting all too frequently results in misalignment of the support column-forming walls and crushing of the containers and their contents.

Plastic stacking inserts have been proposed to overcome the above-described problems and disadvantages encountered with conventional stacking wires. More particularly, as disclosed in commonly assigned U.S. Pat. No. 4,266,714, plastic stacking inserts have been proposed for reception through the vertical slots in aligned double-layer end or side walls of stacked produce containers to maintain said walls in vertical alignment, wherein the stacking inserts include complementary-shaped interlocking structures such that the stacking inserts define load-bearing support columns supplementing the stacking strength of the aligned end or side walls. However, such plastic stacking inserts are relatively costly in comparison with conventional stacking wires, particularly in view of the fact that the stacking device is normally discarded along with the container after the produce is sold.

There exists, therefore, a significant need for an improved stacking device or implement for use with stacked produce containers and the like to prevent crushing of the containers and their contents during storage and/or shipment, wherein the improved device is both inexpensive to manufacture and easy to install. The present invention fulfills this need and provides further related advantages.

SUMMARY OF THE INVENTION

In accordance with the invention, an improved stacking wire is provided for use in handling and stacking produce containers and the like in a secure and stable manner to prevent crushing of stacked containers and their contents during storage and/or shipment. The stacking wire is shaped to fit into aligned vertical slots formed in double-layer end or side walls of a pair of stacked produce containers and to provide an accessible upper handle portion to facilitate carrying and handling of said pair of containers. The stacking wire is further shaped to maintain the aligned wall layers of the two containers in a predetermined spacing and in vertically aligned relation to improve the stacking strength thereof. The handle portion is insertable upwardly into a vertical slot of an additional produce container which may be associated with an additional stacking wire to interlock the pair of containers with additional containers in a stack for palletizing or the like.

In a preferred form of the invention, the improved stacking wire has an inverted, generally U-shaped configuration defining an upper handle portion joined to a pair of upper spacers extending angularly downwardly and in an inboard direction relative to the container. These upper spacers are in turn joined to a pair of downwardly extending legs having their upper ends offset from the plane of the handle portion and their lower ends generally coplanar with the handle portion. The lower ends of the legs are each joined to a foot including an intermediate spacer extending in an inboard direction for connection to a short downwardly extending riser which is in turn joined to a laterally outwardly projecting wing. The wing terminates in a lower spacer bent back in the outboard direction and having a free end disposed generally in the plane of the upper handle portion.

The handle portion of the stacking has a lateral dimension generally corresponding with the lateral width of the vertically open slots in the double-layer end or side wall into which the stacking wire is received, and the legs project downwardly therefrom in a slightly spreading configuration such that the lower wings and lower spacers are laterally separated by a distance greater than the lateral widths of said slots. Moreover, the upper, intermediate, and lower spacers are sized to extend in a direction normal to the lateral slot width for a distance generally corresponding with the thickness of the associated end or side walls.

The stacking wire is installed by orienting the legs thereof in a plane generally perpendicular to a vertical slot formed in a double-layer end wall, for example, of a produce container and then squeezing the legs toward each other a sufficient distance to permit the free ends of the lower spacers to be inserted downwardly into the upper extent of said slot. The legs are then released to urge the wings and lower spacers laterally beyond the side margins of the slot whereupon the legs and handle portion can be rotated upwardly to move the lower spacers to a generally horizontal orientation maintaining the inboard and outboard wall-forming layers in a predetermined spaced relation.

A second produce container then can be stacked onto the aforesaid container with the legs of the stacking wire projecting through an aligned vertical slot in a double-layer end wall of the second container and the handle portion accessible above the second container to provide an easily grasped structure for use in carrying the two containers. Importantly, the intermediate and upper spacers respectively maintain the lower and upper extents of the inboard and outboard wall-forming layers of the second container in a predetermined spacing relative to each other and in a precise vertical alignment relative to the respective wall-forming layers of the lower container. Moreover, when an additional or third container is stacked onto the second container, the handle portion is received upwardly into an aligned slot in the third container and maintained by the upper spacers tightly against the outboard wall-forming layer of the third container thereby maintaining said layer in precise vertical alignment with the outboard wall-forming layer of the container below in the stack. As a result, the wall-forming layers of stacked containers are held tightly in aligned relation against shifting relative to each other to provide a high vertical stacking strength.

Other features and advantages of the present invention will become more apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings:

FIG. 1 is a perspective view illustrating, partly in exploded form, an improved stacking wire embodying the novel features of the invention for use in supporting a stack of containers, such as produce containers or the like;

DETAILED DESCRIPTION OF THE PREFERRED EMBODIMENT

Figure 1:
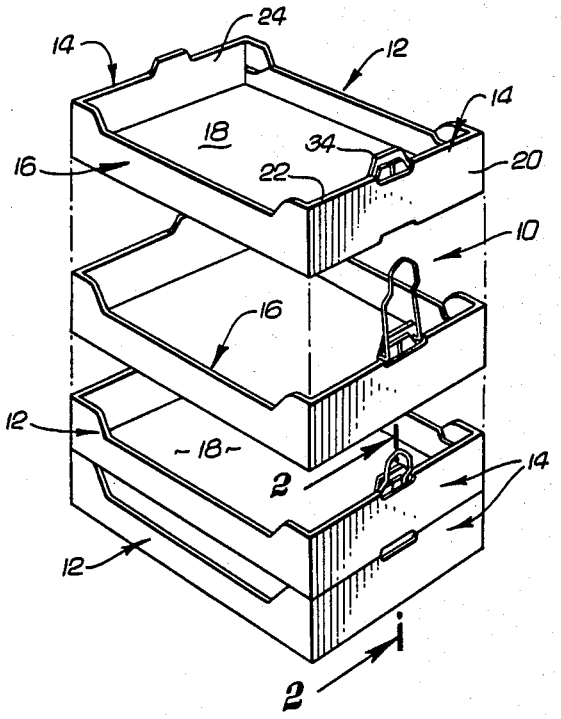

As shown in the exemplary drawings, an improved stacking wire referred to generally by the reference numeral 10 is provided for use in carrying and supporting stacked containers 12, such as containers for produce or the like. The stacking wire 10 interlocks the stacked containers 12 with their end walls 14 and side walls 16 in a precise vertical alignment without shifting during shipment and/or storage to improve the vertical stacking strength of the containers and thereby minimize crushing of the containers and their contents.

The stacking wire 10 of this invention is particularly designed for use with lightweight containers of the type formed from folded blanks of corrugated paperboard or the like and commonly used for shipment and/or storage of small perishable produce items, such as grapes, strawberries, and the like. Such containers 12, which are described and shown in detail by way of example in commonly assigned U.S. Pat. No. 4,266,714 which is incorporated by reference herein, are normally folded or assembled from flat blanks in the field where they are filled with produce and then stacked on pallets or the like for shipment and/or storage prior to ultimate sale.

More specifically, the illustrative produce containers 12 comprise relatively shallow, tray-shaped open-topped containers including a bottom wall 18 bounded by an upstanding pair of the end walls 14 and an upstanding pair of the side walls 16. For optimum vertical stacking strength in a lightweight container, these end and side walls 14 and 16 commonly have a double-layer thickness defined by outboard and inboard layers, as illustrated with respect to the end walls 14 by an upstanding outboard layer 20 joined at its upper extent by a spacer strip 22 to a downwardly extending inboard layer 24 which is locked to the bottom wall 18 as by a tab 26 pressed into a bottom wall opening 28. Moreover, the end and side walls 14 and 16 are normally interlocked relative to each other by locking flaps folded between the inboard and outboard layers of an adjacent wall, as illustrated with respect to double-layer locking flaps 30 joined to the side walls 16 and folded between the outboard and inboard layers 20 and 24 of the adjacent end wall 14.

Figure 2:
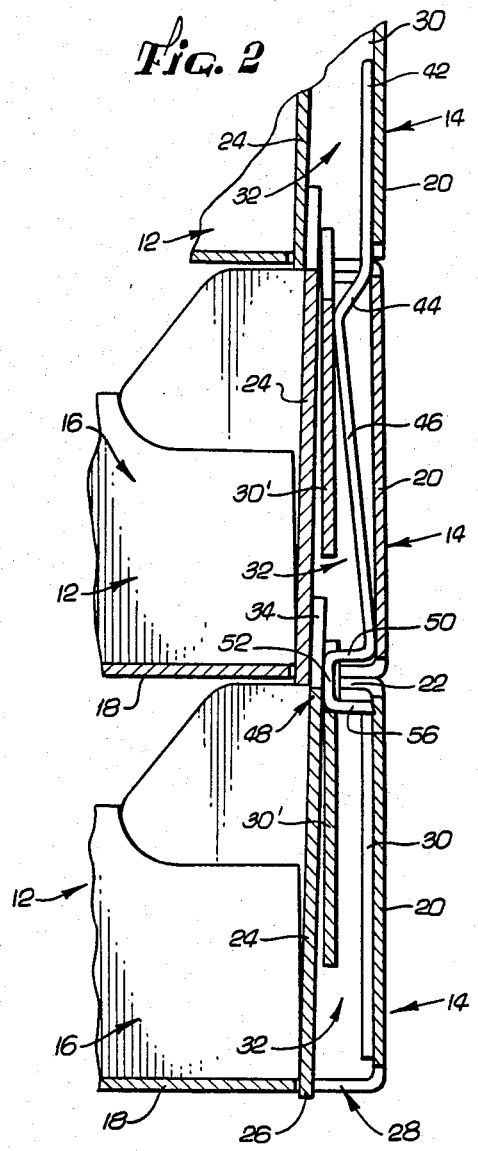
FIG. 2 is an enlarged fragmented vertical section taken generally on the line 2—2 of FIG. 1.

The produce containers 12 of the general type described further include vertically open slots 32 formed in the end walls 14 between the outboard and inboard layers 20 and 24 in a generally central position between the adjacent side walls 16. More particularly, as shown in the illustrative drawings, these slots 32 are defined by the longitudinal spacing between the outboard and inboard layers 20 and 24 and by the tab-receiving opening 28 in the container bottom wall 18 which permits access to the slot from below. At the top of the end wall 14, a central tab 34 is struck upwardly from the spacer strip 22 to define an opening 36 to allow access to the slot 32 from above, wherein this central tab 34 is conveniently sized to fit into the lower opening 28 of another container 10 stacked thereonto, as shown in FIG. 2. Moreover, as illustrated, an inboard layer 30' of the folded locking flaps 30 can be shaped to lie against and reinforce the central tab 34.

The stacking wires 10 of this invention are sized and shaped to fit relatively snugly into the vertical slots 32 in the opposite end walls 14 of a plurality of the produce containers 12 in a stack for maintaining the end walls 14 in a vertically aligned orientation. More particularly, the stacking wire 10 includes a plurality of spacers at different vertical positions for maintaining the outboard and inboard end wall layers 20 and 24 of a produce container 12 in a predetermined spacing relative to each other and with respect to the outboard and inboard end wall layers 20 and 24 of a container 12 stacked thereonto. With this construction, the individual wall-forming layers are supported in a precise vertical alignment and held against longitudinal deformation, sometimes referred to as "shoeing in", to provide the container stack with a relatively high vertical stacking strength resistant to crushing of the container end walls 14 or the produce during storage and/or shipment of stacked containers.

Figure 4:
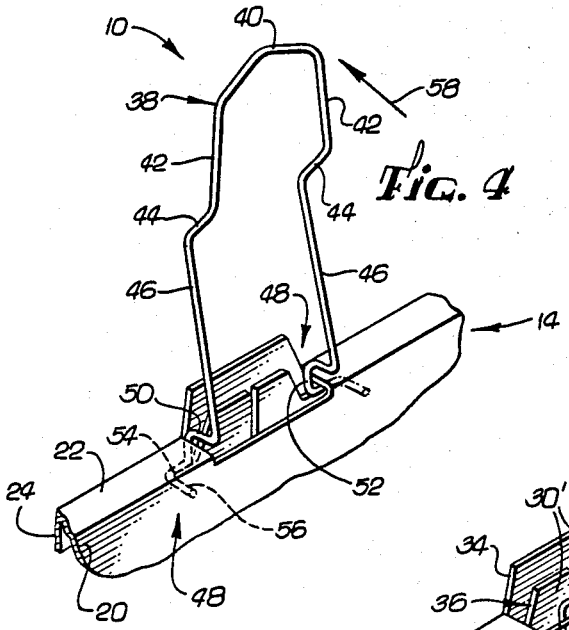
FIG. 4 is an enlarged fragmented perspective view generally similar to FIG. 3 and illustrating further steps in installation of the stacking wire into an operational position.
Figure 3:
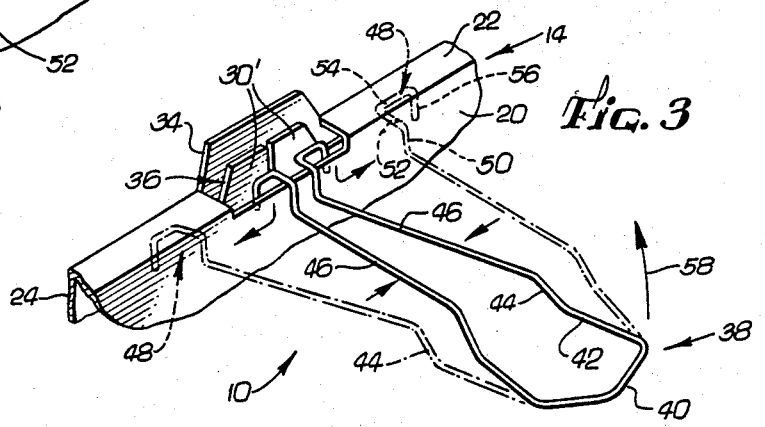
FIG. 3 is an enlarged fragmented perspective view illustrating initial steps in installation of the stacking wire into an operational position relative to a produce container.

The stacking wire 10 is shown in detail in FIGURES. 2–4 to have an inverted, generally U-shaped configuration formed from a bent wire of a type and grade commonly used in stacking wires for produce containers. As illustrated, the stacking wire 10 includes an upper handle portion 38 defined by a cross piece 40 having a length generally corresponding with the transverse width of the vertical slot 32 in an end wall 14 of a container. The cross piece 40 is joined at its opposite ends to a pair of relatively short arm sections 42 which project downwardly where they are joined to a pair of angularly set upper spacers 44.

The upper spacers 44 constitute relatively short wire sections, typically about one-half to three-quarters inch in length, bent from the arm sections 42 to extend downwardly and angularly in an inboard direction relative to the plane of the upper handle portion 38. The upper spacers 44 thus provide an offset structure effectively increasing the thickness of the stacking wire in a direction parallel with the container side walls 16. Importantly, for reasons which will be described herein in more detail, the magnitude of this offset structure generally corresponds with the thickness of the end wall slot 32.

The upper spacers 44 in turn are joined to the upper ends of a pair of legs 46 which project downwardly with a length slightly less than the vertical height of the vertical slot 32 in the container end wall 14. Importantly, these legs 46 are also set angularly relative to the plane of the upper handle portion 38 and extend from the upper spacers 44 downwardly and in an outboard direction. As shown best in FIG. 2, the particular angular setting of the leg 46 is selected such that legs extend from the inboard side to the outboard side of the slots 32 when the upper handle portion 38 is oriented generally in a vertical plane.

The two legs 46 are joined respectively at their lower ends to a pair of feet 48 each defined by a generally horizontally oriented intermediate spacer 50 projecting in an inboard direction for a distance generally equal to the thickness of the end wall slot 32. The intermediate spacer 50 of each foot in turn is connected to a downwardly extending and relatively short riser 52 joined at its lower end to a laterally outwardly turned wing 54. A lower spacer 56 extends from the wing 54 back in an outboard direction for a distance generally equal to the thickness of the slot 32, wherein the lower spacer 56 terminates perferably in a relatively sharply pointed free end.

The stacking wire 10 is inserted into place by orienting the wire in an overall plane generally perpendicular to the end wall 14 of a produce container to permit insertion of the free ends of the lower spacers 56 downwardly into the upper extent of the end wall slot 32. This insertion is achieved by squeezing the legs 46 toward each other from the dotted line configuration to the solid line configuration, as shown in FIG. 3, sufficiently to move the wings 54 and lower spacers 56 toward each other for insertion into the slot through the upper opening 36. After insertion, the legs 46 are released whereupon the inherent spring characteristics of the wire returns the legs 46 to a generally parallel configuration with the risers 52 bearing against the upper strip 22 at the lateral side margins of the slot 32.

The stacking wire is then rotated upwardly about the feet 48 in the direction of arrow 58 in FIGS. 3 and 4 toward a generally upwardly projecting position, as viewed in FIG. 4. This rotates the lower spacers 56 to generally horizontally oriented positions reacting between the outboard and inboard end wall layers 20 and 24 to securely maintain the upper extents of these layers in a predetermined spacing relative to each other. Conveniently, the sharply pointed free ends of the lower spacers 56 may dig slightly into the outboard layer 20 to help prevent slipping or displacement of the lower spacers, and the wings 54 may conveniently rest on top of the locking flap 30' immediately below the upper end wall strip 22 to help prevent downward movement of the stacking wire.

When a pair of the stacking wires 10 are inserted as described into the upper extents of the vertical slots 32 in the opposite end walls 14 of a container, a second container may be stacked on top of the first container. More particularly, as viewed in FIG. 2, the second container is stacked by receiving the stacking wires 10, one of which is shown in FIG. 2, upwardly through its end wall slots 32. Importantly, the intermediate spacers 50 of the wire 10 react between the inboard and outboard layers of the second container, as by reacting between the tab 34 of the first container and the outboard layer 20 of the second container wherein the tab 34 in turn bears against the inboard layer 24 of the second container. Accordingly, the intermediate spacers 50 maintain the lower extents of the end wall layers of the second container in a predetermined spacing and in precise vertical alignment with the associated layers of underlying container.

From the intermediate spacers 50, the legs 46 extend upwardly within the slot 32 and angularly in an inboard direction to engage with the inboard side of the slot near the top thereof, as illustrated in FIG. 2, by engagement with the locking flap 30' lying against the inboard layer 24. The legs 46 thus maintain the inboard and outboard layers 24 and 20 of the second container in a predetermined spacing with each other.

At the upper ends of the legs 46, the stacking wire 10 includes the upper spacers 44 which extend angularly upwardly and in an outboard direction for engagement with the outboard end wall layer 20. Accordingly, the stacking wire also reacts between the inboard and outboard layers of the second container near the top of the slot 32 to further maintain these layers in a predetermined spacing relative to each other. Conveniently, the angular orientation of the upper spacers 44 provides the desired spacing while permitting the second container to slide downwardly over the stacking wire 10 without catching on the upper spacers 44.

From the upper spacers 44, the handle portion 38 projects upwardly in a generally vertical plane lying alongside the inboard face of the outboard end wall layer 20. Importantly, when two of the stacking wires 10 are received through the opposite end wall slots 32 of two stacked containers, the handle portions 38 project upwardly, as viewed in the lower part of FIG. 1, for easy grasping and carrying of the two containers, thereby facilitating container handling.

The upper handle portions 38 further function to help align additional containers to provide a stable and secure stack. When an additional or third container is stacked onto the second container, as viewed in FIG. 2, the upwardly projecting handle portion is received upwardly through the lower opening 28 into the vertically open slot 32 of the third container in bearing relation with the outboard end wall layer 20 of the third container. The handle portion 38 of each stacking wire thus maintains the outboard end wall layers 20 of the second and third containers in a precise vertical alignment to insure a relatively high stacking strength when the containers are stacked.

The third container may, of course, receive an additional pair of stacking wires locking into the upper extents of its end wall slots to permit a further container to be stacked thereonto, as viewed in FIG. 1. That is, the containers are quickly and easily stacked in pairs with associated pairs of stacking wires, whereupon the pairs of containers are quickly and easily stacked on top of each other, typically in grouped stacks of fourteen or sixteen on pallets for storage and/or shipment. Importantly, the inexpensive and easy-to-use stacking wires 10 of this invention maintain the slot-forming end wall layers of the containers in a predetermined spacing to thereby maintain the layers in a precise vertical alignment substantially without lateral shifting or deformtion. As a result, the stacking wires lock the end walls in a position defining a rigid support column having high stability and stacking strength to prevent crushing of the containers or their contents during storage and/or shipment.

A variety of modifications and improvements to the stacking wire of this invention are believed to be apparent to one skilled in the art. Accordingly, no limitation on the invention is intended by way of the description herein, except as set forth in the appended claims.

What is claimed is:

1. A stacking wire for use in stacking produce containers or the like having a double-layer end wall defining a vertically open slot for receiving the stacking wire, comprising:

a handle portion including a cross piece having a length generally corresponding with the transverse width of the end wall slot;

a pair of first spacers joined to opposite ends of said handle portion and extending in a direction generally perpendicular with respect to said cross piece for a distance generally corresponding with the thickness of the end wall slot;

a pair of legs joined respectively to said first spacers and extending generally downwardly therefrom; and a pair of feet joined respectively to the lower ends of said legs, each of said feet including an intermediate spacer extending from the lower end of the associated leg in a direction generally perpendicular to said cross piece for a distance generally corresponding with the thickness of the end wall slot, a relatively short riser extending generally downwardly from said intermediate spacer, a wing projecting laterally outwardly from the lower end of said riser, and a second spacer extending generally perpendicular with respect to said cross piece for a distance generally corresponding with the thickness of the end wall slot and being joined generally to the laterally outer end of said wing;

said wing and second spacer of said feet being receivable into the upper extent of an end wall slot in a first container to maintain the end wall layers thereof in a predetermined spacing, said intermediate spacers of said feet being receivable into the lower extent of an end wall slot in a second container stacked onto said first container to maintain the end wall layers of said second container in said predetermined spacing and in vertical alignment with the end wall layers of said first container, said first spacers being thereupon positioned to maintain the upper extent of the second container end wall layers at said predetermined spacing, said cross piece being receivable into the lower extent of the end wall slot in a third container stacked onto said second container.

2. The stacking wire of claim 1 wherein said handle portion further includes a pair of arm sections extending generally downwardly from the opposite ends of said cross piece, said first spacers being joined respectively to the lower ends of said arm sections and extending therefrom in a direction generally perpendicular to said cross piece and said arm sections.

3. The stacking wire of claim 2 wherein said first spacers each extend from the free ends of said arm sections angularly downwardly and with a component of direction generally perpendicular to said cross piece and said arm sections, said component of direction having a magnitude generally corresponding with the thickness of the end wall slot.

4. The stacking wire of claim 1 wherein said legs have a vertical height at least slightly less than the vertical height of the end wall slot.

5. The stacking wire of claim 1 wherein said legs extend generally downwardly from said first spacers with an increasing lateral spacing.

6. The stacking wire of claim 3 wherein said legs extend generally angularly downwardly relative to the plane of said handle portion from the lower ends of said first spacers, said legs terminating at their lower ends generally in the plane of said handle portion.

7. The stacking wire of claim 6 wherein said second spacers each have relatively sharply pointed free ends.

8. A stacking wire for use in stacking produce containers or the like having a double-layer end wall defining a vertically open slot for receiving the stacking wire, comprising:

an inverted, generally U-shaped wire member bent to include a cross piece having a length generally corresponding with the transverse width of the end wall slot, a pair of leg portions extending generally downwardly from the opposite ends of said cross piece, each of said leg portions including along its length at least one first spacer extending with a component of direction and for a distance generally corresponding with the thickness of the end wall slot when said cross piece is aligned generally in parallel with the slot width, and a pair of feet joined respectively to the lower ends of said leg portions, each of said feet including an intermediate spacer joined to the lower end of the associated leg portion and extending in a direction generally perpendicular to said cross piece for a distance generally corresponding with the thickness of the end wall slot, a relatively short riser extending generally downwardly from said intermediate spacer, a wing projecting laterally outwardly from the lower end of said riser, and a second spacer extending generally in parallel with said first spacer component of direction and for a distance generally corresponding with the thickness of the end wall slot and being joined generally to the laterally outer end of said wing;

said wing and second spacer of said feet being receivable into the upper extent of an end wall slot in a first container to maintain the end wall layers thereof in a predetermined spacing, said intermediate spacers of said feet being receivable into the lower extent of an end wall slot in a second container stacked onto said first container to maintain the end wall layers of said second container in said predetermined spacing and in vertical alignment with the end wall layers of said first container, said first spacers being thereupon positioned to maintain the upper extent of the second container end wall layers at said predetermined spacing, said cross piece being receivable into the lower extent of the end wall slot in a third container stacked onto said second container.

9. The stacking wire of claim 8, wherein said leg portions include a pair of arm sections extending generally downwardly from the opposite ends of said cross piece, said arm sections and said cross piece cooperating to define a generally vertical plane, said first spacers being joined to the lower ends of said arm sections and extending with said component of direction generally perpendicular to said vertical plane, and further including a pair of legs respectively coupled between the lower ends of said first spacers and said feet.

10. The stacking wire of claim 9 wherein each of said first spacers extends generally angularly downwardly and with said generally perpendicular component of direction from the lower ends of said arm sections.

11. The stacking wire of claim 8 wherein said legs have a vertical height at least slightly less than the vertical height of the end wall slot.

12. The stacking wire of claim 8 wherein said leg portions extend generally downwardly from said cross piece with an increasing lateral spacing.

13. The stacking wire of claim 9 wherein said legs extend generally downwardly from the lower ends of said first spacers and angularly with respect to said vertical plane, the lower ends of said legs terminating generally in said vertical plane.

14. A stacking wire for use in stacking produce containers or the like having a double-layer end wall defining a vertically open slot for receiving the stacking wire, comprising:

a handle portion including a cross piece having a length generally corresponding with the transverse width of the end wall slot;

a pair of arm sections extending generally downwardly from opposite ends of said cross piece and generally in a plane common to said cross piece;

a pair of first spacers joined to the lower ends of said arm sections, said first spacers each extending generally angularly therefrom downwardly and in a first direction generally perpendicular to said common plane, said first spacers extending in said first direction for a distance generally corresponding with the thickness of the end wall slot;

a pair of legs joined respectively to said first spacer and extending generally downwardly therefrom; and a pair of feet joined respectively to the lower ends of said legs, each of said feet including an intermediate spacer extending in said first direction for a distance generally corresponding with the thickness of the end wall slot, a relatively short riser extending downwardly from said intermediate spacer, a laterally outwardly projecting wing joined to the lower end of said riser, and a second spacer projecting from the outer extent of said wing in a direction generally opposite said first direction and for a distance generally corresponding with the thickness of the end wall slot;

said wing and second spacer of said feet being receivable into the upper extent of an end wall slot in a first container to maintain the end wall layers thereof in a predetermined spacing, said intermediate spacers of said feet being receivable into the lower extent of an end wall slot in a second container stacked onto said first container to maintain the end wall layers of said second container in said predetermined spacing and in vertical alignment with the end wall layers of said first container, said first spacers being thereupon positioned to maintain the upper extents of the second container end wall layers at said predetermined spacing, said cross piece and said arm sections being receivable into the lower extent of the end wall slot in a third container stacked onto said second container.

15. The stacking wire of claim 14 wherein said legs extend generally downwardly from said first spacers with an increasing lateral spacing.

16. The stacking wire of claim 14 wherein said second spacers each have relatively sharply pointed free ends.

17. The stacking wire of claim 14 wherein said cross piece and said arm section are disposed to bear against one of the end wall layers of said third container to support said one end wall layer in vertical alignment with the associated end wall layer of said second container.

18. The stacking wire of claim 14 wherein said legs extend generally downwardly from the lower ends of said first spacers and angularly with respect to said common plane, the lower ends of said legs terminating generally in said common plane.

19. A stacking wire for use in stacking produce containers or the like having a double-layer end wall defining a vertically open slot for receiving the stacking wire, comprising:

an inverted, generally U-shaped wire member bent to include a cross piece having a length generally corresponding with the transverse width of the end wall slot, and a pair of leg portions extending generally downwardly from the opposite ends of said cross piece, said leg portions respectively including a pair of feet having means for locking reception into the upper extent of the end wall slot of a first container and for maintaining the end wall layers in a predetermined spacing relative to each other, said leg portions being receivable upwardly into the end wall slot of a second container stacked onto said first container, said feet further including means for maintaining the lower extents of the second container end wall layers in vertical alignment with the first container end wall layers and said leg portions further including means for maintaining the upper extents of the second container end wall layers in said predetermined spacing.

20. The stacking wire of claim 19 wherein said leg portions further include means for maintaining at least one of the end wall layers of a third container stacked onto said second container in vertical alignment with the associated end wall layer of said second container.

* * * * *